US008171838B2

(12) United States Patent
Heitmann

(10) Patent No.: US 8,171,838 B2
(45) Date of Patent: May 8, 2012

(54) METHOD FOR INSERTING PREDETERMINED BREAKING POINTS IN A RING-SHAPED HOLDING- AND SEALING BAND OF A SABOT CAGE PROJECTILE AND A WORK TOOL FOR CARRYING OUT THE METHOD

(75) Inventor: Thomas Heitmann, Unterlüß (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 237 days.

(21) Appl. No.: 12/709,431

(22) Filed: Feb. 19, 2010

(65) Prior Publication Data

US 2010/0212479 A1 Aug. 26, 2010

(30) Foreign Application Priority Data

Feb. 20, 2009 (DE) ..... 10 2009 009 772

(51) Int. Cl.
*F42B 14/06* (2006.01)
*F42B 33/00* (2006.01)

(52) U.S. Cl. ..... 86/52; 102/520

(58) Field of Classification Search ..... 102/520, 102/521, 522, 523; 86/52, 51
See application file for complete search history.

(56) References Cited

U.S. PATENT DOCUMENTS 3,620,167 A 11/1971 Romer et al.
4,140,061 A * 2/1979 Campoli ..... 102/529
4,195,573 A 4/1980 Leeker et al.
4,362,107 A 12/1982 Romer et al.
4,444,113 A * 4/1984 Campoli ..... 102/430
4,450,770 A * 5/1984 Kirkendall et al. ..... 102/523
5,063,855 A 11/1991 Diel et al.

(Continued)

FOREIGN PATENT DOCUMENTS

DE 1703507 A 3/1972

(Continued)

OTHER PUBLICATIONS

"formschlüssig, kraftschlüssing> form-fit[ted], force-fit[ted]," at http://www.proz.com/kudoz/german_to_english/engineering_genera..., downloaded Sep. 13, 2011, three pages, filed in co-pending related U.S. Appl. No. 12/709,411 ad "Exhibit A."

(Continued)

*Primary Examiner* — James Bergin
(74) *Attorney, Agent, or Firm* — Griffin & Szipl, P.C.

(57) ABSTRACT

A method and work tool for inserting predetermined breaking points in a ring-shaped holding- and sealing band of a sabot cage projectile with an impact sabot cage are provided, wherein the band is arranged on a partial area of a receptacle device segmented through at least two longitudinal slits. The receptacle device connects the propelling element to the guiding cage of the impact sabot cage, and the guiding cage is segmented through at least two longitudinal slits. After mounting the band on the receptacle device, but before installation of the guiding cage in the area of the holding- and sealing band covering the longitudinal slits of the receptacle device, notch-shaped predetermined breaking points are inserted in the holding- and sealing band from inside of the band with the aid of a work tool, wherein longitudinal slits of the receptacle device are used for lateral guiding of the work tool.

5 Claims, 3 Drawing Sheets

U.S. PATENT DOCUMENTS

| | | | |
|---|---|---|---|
| 6,019,217 | A | 2/2000 | Melan et al. |
| 6,854,394 | B2 | 2/2005 | Henry et al. |
| 7,152,533 | B2 | 12/2006 | Eches et al. |
| 7,197,984 | B2 | 4/2007 | Eches |
| 7,503,262 | B2 | 3/2009 | Eches et al. |
| 7,594,472 | B1 | 9/2009 | Parratt et al. |
| 7,934,456 | B1 | 5/2011 | Heitmann et al. |

FOREIGN PATENT DOCUMENTS

| | | | |
|---|---|---|---|
| DE | 27 47 313 | C2 | 1/1983 |
| DE | 39 37 665 | A1 | 5/1991 |

OTHER PUBLICATIONS

"Verbindungstechnik," at http://de.wikipedia.org/wiki/Verbindungstechnik, downloaded Sep. 13, 2011, three pages, filed in co-pending related U.S. Appl. No. 12/709,411 as "Exhibit B."

English translation of "Exhibit B" above obtained from translate.googleusercontent.com, filed in co-pending related U.S. Appl. No. 12/709,411 as "Exhibit C."

Online German-to-English dictionary, available at http://dict.tu-chemnitz.de/deutsch-englisch/Formschluss.html, downloaded Sep. 13, 2011, one page, filed in co-pending related U.S. Appl. No. 12/709,411 as "Exhibit D."

Online German-to-English dictionary, available at http://dict.tu-chemnitz.de/dings.cgi?lang=en&service=deen&opterrors=0&optpro=0&query=Kraftschluss&iservice=&comment=&email=, downloaded Sep. 13, 2011, one page, filed in co-pending related U.S. Appl. No. 12/709,411 as "Exhibit E."

"Formschluss" at http://smerobot-tools.prospektiv.de/glossar/deu/formschluss.html, downloaded Sep. 13, 2011, one page, filed in co-pending related U.S. Appl. No. 12/709,411 as "Exhibit F."

English translation of "Exhibit F" above obtained from translate.googleusercontent.com, filed in co-pending related U.S. Appl. No. 12/709,411 as "Exhibit G."

Webpage available at http://www.lasiportal.de/ladungssicherung/grundwissen/arten-der-lasi/kraftschluss/kraftschluessige-sicherung-und-sicherung-durch-reibschluss.php, two pages, filed in co-pending related U.S. Appl. No. 12/709,411 as "Exhibit H."

English translation of "Exhibit H" above obtained from translate.googleusercontent.com, filed in co-pending related U.S. Appl. No. 12/709,411 as "Exhibit I."

"Kraftschluss," at http://www.proz.com/kudoz/german_to_english/engineering%3A_industrial/1643678-kraftschluss.html, downloaded Sep. 13, 2011, three pages, filed in co-pending related U.S. Appl. No. 12/709,411 as "Exhibit J."

"Formschluss > form mating," at http://www.proz.com/?sp=gloss/term&id=1739480, downloaded Sep. 13, 2011, one page, filed in co-pending related U.S. Appl. No. 12/709,411 as "Exhibit K."

"Reibschluss" at http://145.253.206.136/bosch/wbt_stein/content/technologien/befestigungstechnik/reibschluss/index_ger.html?html_b=1, downloaded Sep. 13, 2011, one page, filed in co-pending related U.S. Appl. No. 12/709,411 as "Exhibit L."

Office Action issued in co-pending related U.S. Appl. No. 12/709,411, mailed Jun. 21, 2011.

Notice of Allowance issued in co-pending related U.S. Appl. No. 12/709,411 on Jan. 25, 2012.

* cited by examiner

METHOD FOR INSERTING PREDETERMINED BREAKING POINTS IN A RING-SHAPED HOLDING- AND SEALING BAND OF A SABOT CAGE PROJECTILE AND A WORK TOOL FOR CARRYING OUT THE METHOD

This application claims priority from German Patent Application No. DE 10 2009 009 772.4, filed Feb. 20, 2009, the entire disclosure of which is incorporated herein by reference.

FIELD OF THE INVENTION

The invention relates to a method for inserting predetermined breaking points in a ring-shaped holding- and sealing band of a sabot cage projectile with an impact sabot cage, wherein the holding- and sealing band is arranged on a partial area of a receptacle device segmented through at least two longitudinal slits, wherein the receptacle device connects the propelling element to the guiding cage of the impact sabot cage projectile, and the guiding cage is segmented through at least two longitudinal slits. The invention further relates to a work tool for carrying out the method.

BACKGROUND OF THE INVENTION

In known large-caliber sabot cage projectiles, which respectively include a sub-caliber penetrator and a center sabot cage segmented through longitudinal slits (i.e., a 2-flange sabot cage), the sabot cage segments are held together before firing, i.a., by the guiding- and sealing band arranged on the rear flange. In order to achieve a reproducible release of the sabot cage segments as soon as the sabot cage projectile has passed the muzzle of the corresponding weapon barrel, predetermined breaking points are usually sunk into the guiding band, wherein the breaking points effect a defined rupture of the sabot cage segments along the longitudinal slits. The disadvantage with these known sabot cage projectiles is the relatively high costs associated with the milling for insertion of the predetermined breaking points in the sealing band.

In large-caliber sabot cage projectiles provided with an impact sabot cage, a guiding cage segmented through longitudinal slits is adjacent at the front to the propelling element of the impact sabot cage, wherein the guiding cage is connected at the rear to the propelling element via a segmented receptacle device and at the front to a guiding disk. The segmented receptacle device is held together thereby through a holding- and sealing band.

In order to ensure a defined release of the segments of the receptacle device, including the segments of the guiding cage after firing also in sabot cage projectiles of this type, it would be advantageous per se to mill predetermined breaking points into the holding- and sealing band, likewise. However, the expense for the milling process would also be relatively time- and cost-intensive in this case.

The object of the present invention is to disclose a method with which predetermined breaking points are inserted in the holding- and guiding band of an, in particular large-caliber, sabot cage projectile provided with an impact sabot cage in a cost-effective manner. Moreover, a work tool is to be disclosed with which the method, according to the invention, can be carried out.

SUMMARY OF THE INVENTION

This object of the invention is achieved according to the invention as far as the method is concerned by the features of a first embodiment and, as far as the work tool is concerned, by the features of a fourth embodiment of the invention. Various other particularly advantageous embodiments of the invention are also summarized below.

Thus, in accordance with a first embodiment of the present invention, a method for inserting predetermined breaking points (16) in a ring-shaped holding- and sealing band (14) of a sabot cage projectile (1) with an impact sabot cage (4) is provided, wherein the holding- and sealing band (14) is arranged on a partial area (15) of a receptacle device (9) segmented through at least two longitudinal slits (8), and wherein the receptacle device connects the propelling element (5) to the guiding cage (6) of the impact sabot cage (4) segmented through at least two longitudinal slits, wherein in accordance with the method, after the holding- and sealing band (14) has been mounted on the receptacle device (9), but before the installation of the guiding cage (6), in the area of the holding- and sealing band (14) covering the longitudinal slits (8) of the receptacle device (9), notch-shaped predetermined breaking points (16) are inserted into the holding- and sealing band (14) from the inside of this holding- and sealing band (14) with the aid of an appropriate work tool (17), wherein the longitudinal slits (8) of the receptacle device (9) are used for the lateral guiding of the work tool (17).

In accordance with a second embodiment of the present invention, the first embodiment is modified so that the insertion of the notch-shaped predetermined breaking points (16) in the holding- and sealing band (14) takes place through axial pushing of the work tool (17). In accordance with a third embodiment of the present invention, the first embodiment or the second embodiment is further modified so that the insertion of the notch-shaped predetermined breaking points (16) into the holding- and sealing band (14) takes place simultaneously with the application of the holding- and sealing band (14) onto the receptacle device (9).

In accordance with a fourth embodiment of the present invention, a work tool for carrying out the method according to the first embodiment, the second embodiment and the third embodiment, is characterized in that the work tool (17) includes a ring-shaped head part (18) that can be pushed axially at least partially onto the receptacle device (9), and that at the head part (18) a number of knife-shaped blade-shaped tools (20) with blades (21) directed outwards are arranged, wherein the number of knife-shaped blade-shaped tools corresponds to the number of segments (10, 11) of the receptacle device (9), wherein the blades extend axially in front of the head part (18) in such a way that when the head part (18) is pushed onto the receptacle device (9), then the holding- and sealing band (14) situated behind this push-on area (19) is provided with the corresponding notch-shaped predetermined breaking points (18).

Thus, the invention is based essentially on the concept that after the mounting of the holding- and sealing band on the receptacle device, but before the installation of the guiding cage, in the area of the holding- and sealing band covering the longitudinal slits of the receptacle device notch-shaped predetermined breaking points are inserted into the holding- and sealing band from the inside with the aid of blade-shaped tools, wherein the longitudinal slits of the segmented receptacle device are used for the lateral guiding of the blade-shaped tools. Through the matching of the blade-shaped tools to the longitudinal slits of the receptacle device, the notching in the holding- and sealing band is always positioned with sufficient precision. Moreover, through the use of a notching on the inside in the area of the longitudinal slits of the holding- and sealing band, the notch action is strengthened through the pressing together of the holding- and sealing band effected through the barrel wall at the firing of the corresponding projectile arrangement. The insertion of the notch-shaped predetermined breaking points in the holding- and sealing band arises preferably through the press seating of the holding band to the receptacle device, but can also be created through an axial displacement of the blade-shaped tools.

It is particularly advantageous when the notch-shaped predetermined breaking points are inserted in the holding- and sealing band during the mounting of the holding- and sealing band on the receptacle device because, then, separate operations for the insertion of the predetermined breaking points can be omitted.

The work tool preferably includes a ring-shaped head part that can be pushed axially at least partially onto the receptacle device and that has, at the head part, a number of knife-shaped blade-shaped tools with blades directed outwards, wherein the number of knife-shaped blade-shaped tools corresponds to the number of segments of the receptacle device. These blades extend axially in front of the head part in such a way that, when the head part is pushed onto the receptacle device, the holding- and sealing band situated behind this push-on area is provided with the corresponding notch-shaped predetermined breaking points.

A cost-effective kinetic energy drill round projectile is also disclosed with this design solution.

BRIEF DESCRIPTION OF THE DRAWINGS

Further details and advantages of the invention are disclosed by the following exemplary embodiments explained based on the following Figures, which show.

DETAILED DESCRIPTION OF THE INVENTION

Figure 1:
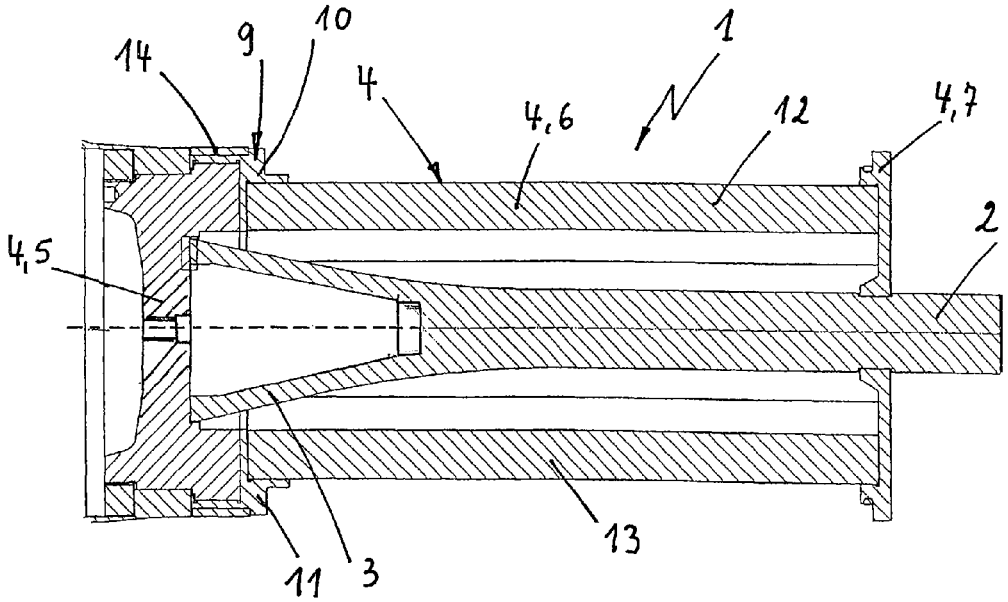
FIG. 1 illustrating a longitudinal section through a sabot cage projectile with an impact sabot cage, wherein, at the rear propelling element, a receptacle device segmented through two longitudinal slits lying opposite one another is arranged, wherein the segments of the receptacle device are held together by a holding- and sealing band provided with predetermined breaking points.
Figure 2:
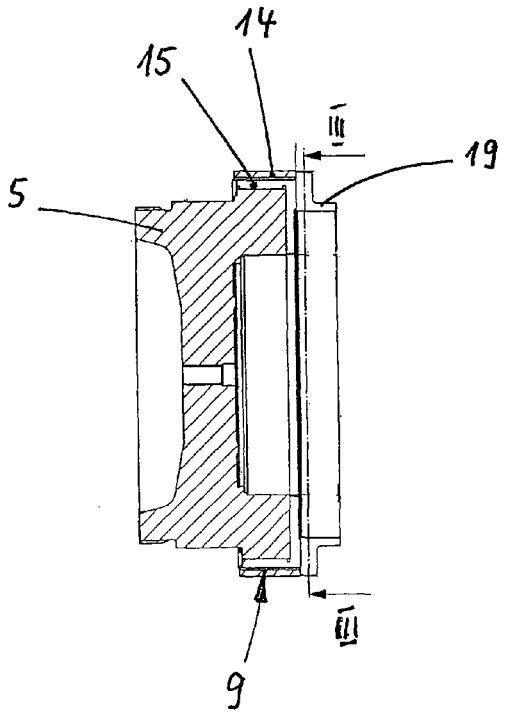
FIG. 2 shows a longitudinal section of the propelling element shown in FIG. 1 with segmented receptacle device and holding- and sealing band, wherein the longitudinal section lies in the plane of the longitudinal slits separating the two segments.

In FIG. 1, 1 designates a large-caliber practice projectile embodied as a sabot cage projectile (e.g. a 120 mm practice projectile to be shot from a tank cannon), wherein the projectile includes a sub-caliber projectile body 2 with a cone control unit 3 and an impact sabot cage 4. The impact sabot cage 4 comprises essentially a propelling element 5 (also called a pusher plate) acting on the projectile body 2 at the rear, a cylinder-shaped guiding cage 6 segmented through two longitudinal slits lying opposite one another is adjacent at the front to the propelling element 5, and a segmented support wall 7 arranged in the front area of the guiding cage 6, extending radially inwards, and holding the projectile body 2.

The connection between the guiding cage 6 and the propelling element 5 takes place with the aid of a receptacle device 9, likewise segmented through two longitudinal slits 8 lying opposite one another, wherein the receptacle device is connected to the propelling element 5 at the rear in a non-positive manner by means of an adhesive connection. The two dish-shaped segments 10, 11 of the receptacle device 9 (and thus also the two dish-shaped segments 12, 13 of the guiding cage 6) are held together through a ring-shaped holding- and sealing band 14 made, for example, of plastic, and the band is arranged on a rear area 15 of the receptacle device 9.

Figure 3:
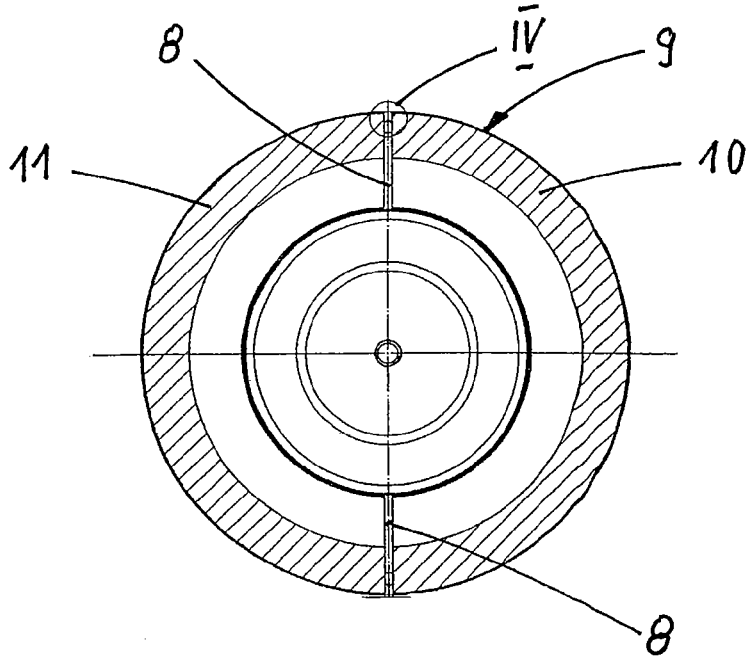
FIG. 3 is a cross section viewed along the line of cut indicated in FIG. 2 by III-III.
Figure 4:
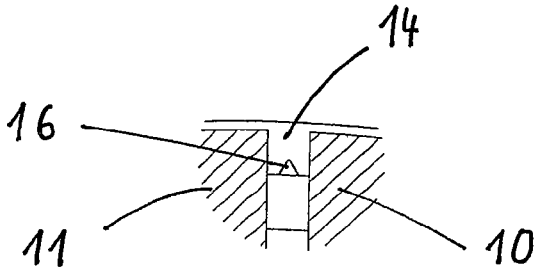
FIG. 4 shows an enlarged representation of the area indicated in FIG. 3 by IV.
Figure 5:
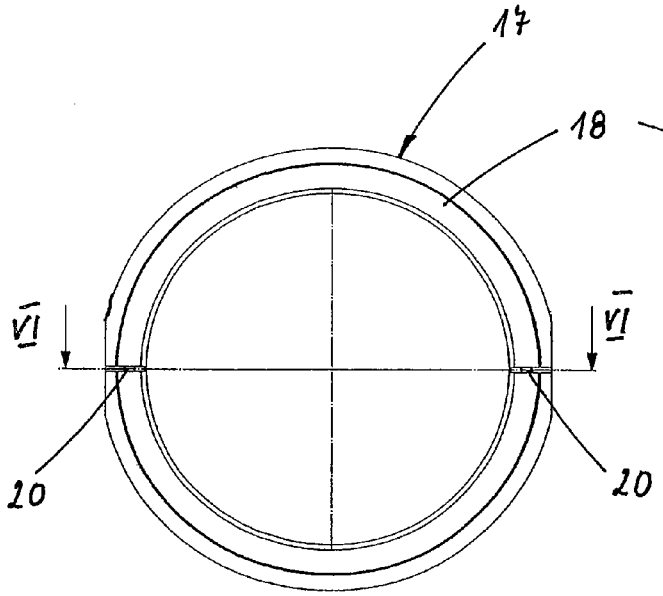
FIG. 5 is a plan view of a work tool for inserting predetermined breaking points into the holding- and sealing band.
Figure 7:
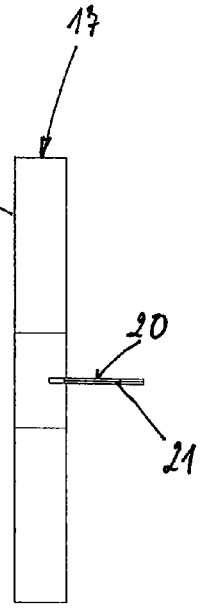
FIG. 7 is a side view of the left side of the work tool shown in FIG. 5.
Figure 6:
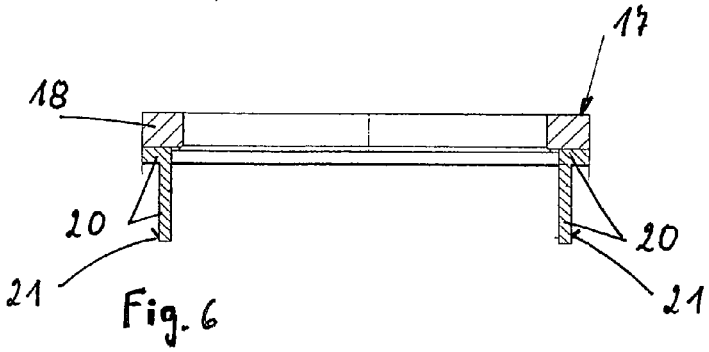
FIG. 6 is a cross section view taken along the line of cut indicated in FIG. 5 by VI-VI.

In order to ensure a defined release of the segments 10, 11 of the receptacle device 9 (and thus also of the segments 12, 13 of the guiding cage 6) after firing, according to the invention, notch-shaped predetermined breaking points 16 are provided in the holding- and sealing band 14 on the inside in the area of the holding- and sealing band 14 covering the longitudinal slits 8 of the receptacle device 9 (c.f., FIG. 3 and FIG. 4). These predetermined breaking points 16 are inserted with the aid of a work tool 17 (FIG. 5-7) that includes a ring-shaped head part 18, wherein the ring-shaped head part can be pushed axially at least partially onto the front area of the receptacle device 9 and, thus, has an inner diameter that corresponds approximately to the outer diameter of the front area 19 of the receptacle device 9.

At the head part 18 of the work tool 17, two knife-shaped blade-shaped tools 20 lying opposite one another (preferably exchangeable) with blades 21 directed outwards are fixed, wherein the blades extend axially in front of the head part 18 and are arranged on the head part 18 in such a way that when the head part 18 is pushed onto the receptacle device 9, then the holding- and sealing band 14 situated behind this push-on area 19 of the receptacle device 9 is provided with the corresponding notch-shaped predetermined breaking points 16. The insertion of the predetermined breaking points 16 into the holding- and sealing band 14 is carried out, therefore, before the installation of the guiding cage 6, and, in fact, preferably simultaneously with the mounting of the holding- and sealing band 14 on the receptacle device 9. The ring-shaped head part 18 of the work tool 17 serves, thereby, as a press tool for the axial pushing of the holding-shaped and sealing band 14 onto the receptacle device 9.

LIST OF REFERENCE NUMBERS

1 Sabot cage projectile
2 Projectile body
3 Cone control unit
4 Impact sabot cage
5 Propelling element
6 Guiding cage
7 Support wall
8 Longitudinal slit
9 Receptacle device
10, 11 Segments (receptacle device)
12, 13 Segments (guiding cage)
14 Holding- and sealing band
15 Rear area, partial area
16 Predetermined breaking point
17 Work tool
18 Head part
19 Front area, push-on area
20 Cutting tool
21 Blade

The invention claimed is:

1. A method for inserting predetermined breaking points in a ring-shaped holding- and sealing band of a sabot cage projectile provided with an impact sabot cage, wherein the method comprises the steps of:

(a) arranging the holding- and sealing band on a partial area of a receptacle device segmented through at least two longitudinal slits so that the holding- and sealing band is mounted on the receptacle device, wherein the receptacle device connects a propelling element to a guiding cage of the impact sabot cage segmented through at least two longitudinal slits in the receptacle device; and (b) inserting notch-shaped predetermined breaking points into an area of the holding- and sealing band covering the longitudinal slits of the receptacle device, from an inside of the holding- and sealing band with the aid of a work tool, wherein the longitudinal slits of the receptacle device are used for lateral guiding of the work tool, and wherein the breaking points are inserted after the holding- and sealing band has been mounted on the receptacle device, but before installation of the guiding cage.

2. A method according to claim 1, wherein insertion of the notch-shaped predetermined breaking points in the holding- and sealing band takes place through axial pushing of the work tool.

3. A method according to claim 2, wherein insertion of the notch-shaped predetermined breaking points into the holding- and sealing band takes place simultaneously with mounting of the holding- and sealing band onto the receptacle device.

4. A method according to claim 1, wherein insertion of the notch-shaped predetermined breaking points into the holding- and sealing band takes place simultaneously with mounting of the holding- and sealing band onto the receptacle device.

5. A work tool, wherein the work tool includes:

(a) a ring-shaped head part that is pushable axially at least partially onto the receptacle device;

(b) a number of knife-shaped blade-shaped tools provided with blades directed outwards arranged at the head part, wherein the number of knife-shaped blade-shaped tools corresponds to the number of segments of the receptacle device, wherein the blades extend axially in front of the head part so that when the head part is pushed onto the receptacle device, the holding- and sealing band situated behind a push-on area is provided with the corresponding notch-shaped predetermined breaking points, and wherein the work tool carries out a method for inserting predetermined breaking points in a ring-shaped holding- and sealing band of a sabot cage projectile provided with an impact sabot cage, wherein the method comprises the steps of:

(i) arranging the holding- and sealing band on a partial area of a receptacle device segmented through at least two longitudinal slits so that the holding- and sealing band is mounted on the receptacle device, wherein the receptacle device connects a propelling element to a guiding cage of the impact sabot cage segmented through at least two longitudinal slits in the receptacle device; and (ii) inserting notch-shaped predetermined breaking points into an area of the holding- and sealing band covering the longitudinal slits of the receptacle device, from an inside of the holding- and sealing band with the aid of a work tool, wherein the longitudinal slits of the receptacle device are used for lateral guiding of the work tool, and wherein the breaking points are inserted after the holding- and sealing band has been mounted on the receptacle device, but before installation of the guiding cage.

* * * * *